US012800153B2

(12) United States Patent
Xiao

(10) Patent No.: US 12,800,153 B2
(45) Date of Patent: Nov. 17, 2026

(54) EXHAUST WINDOW ASSEMBLY AND A COOKING DEVICE

(71) Applicant: Zhejiang Shaoxing Supor Domestic Electrical Appliance Co., Ltd., Shaoxing (CN)

(72) Inventor: Zhiyi Xiao, Shaoxing (CN)

(73) Assignee: Zhejiang Shaoxing Supor Domestic Electrical Appliance Co., Ltd., Shaoxing (CN)

( * ) Notice: Subject to any disclaimer, the term of this patent is extended or adjusted under 35 U.S.C. 154(b) by 348 days.

(21) Appl. No.: 18/640,501

(22) Filed: Apr. 19, 2024

(65) Prior Publication Data

US 2024/0369232 A1 Nov. 7, 2024

(30) Foreign Application Priority Data

May 6, 2023 (CN) ..... 202321110568.X

(51) Int. Cl.
*F24C 15/20* (2006.01)
*F24C 15/00* (2006.01)
*F24C 15/30* (2006.01)

(52) U.S. Cl.
CPC ..... *F24C 15/2007* (2013.01); *F24C 15/006* (2013.01); *F24C 15/30* (2013.01)

(58) Field of Classification Search
CPC .... F24C 15/2007; F24C 15/006; F24C 15/30; F24C 15/322
See application file for complete search history.

(56) References Cited

U.S. PATENT DOCUMENTS

| | | | | |
|---|---|---|---|---|
| 12,078,359 | B2 * | 9/2024 | Weilert | A47J 37/0658 |
| 2020/0229640 | A1 | 7/2020 | Han et al. | |
| 2022/0397287 | A1 | 12/2022 | Kim et al. | |

FOREIGN PATENT DOCUMENTS

| | | | | |
|---|---|---|---|---|
| CN | 206962163 U | | 2/2018 | |
| CN | 207400665 U | * | 5/2018 | |
| CN | 108720643 A | * | 11/2018 | A47J 37/1209 |
| CN | 214230896 U | * | 9/2021 | |
| CN | 215687021 U | | 2/2022 | |
| CN | 217118218 U | | 8/2022 | |
| CN | 217390518 U | | 9/2022 | |
| CN | 218186410 U | * | 1/2023 | |
| CN | 218355794 U | * | 1/2023 | |
| CN | 220713713 U | * | 4/2024 | |
| CN | 221830456 U | * | 10/2024 | |
| CN | 222533139 U | * | 2/2025 | |
| CN | 121003377 A | * | 11/2025 | A47J 27/04 |
| CN | 223715483 U | * | 12/2025 | |

(Continued)

OTHER PUBLICATIONS

Search Report filed on May 6, 2023 from the Office Action for Chinese Application No. 202321110568.X, pp. 1-5.

*Primary Examiner* — Jesse S Bogue
(74) *Attorney, Agent, or Firm* — Lerner David LLP

(57) ABSTRACT

Embodiments of the present application provide an exhaust window assembly and a cooking device. The exhaust window assembly comprises: an exhaust window body provided with first vents; and an exhaust window base connected to the exhaust window body, a part of the exhaust window base extending out of the exhaust window body, the first vents being distributed outside the exhaust window base.

14 Claims, 16 Drawing Sheets

(56) References Cited

FOREIGN PATENT DOCUMENTS

| | | | | | |
|---|---|---|---|---|---|
| EP | 4289318 | A1 | 12/2023 | | |
| WO | 2022166149 | A1 | 8/2022 | | |
| WO | WO-2026067300 | A1 * | 4/2026 | ..... | A47J 37/06 |

* cited by examiner

EXHAUST WINDOW ASSEMBLY AND A COOKING DEVICE

CROSS-REFERENCE TO RELATED APPLICATIONS

This application claims priority from Chinese patent application number 202321110568.X, filed May 6, 2023, the disclosure of which is incorporated herein by reference.

FIELD

The present application relates to the field of cooking devices, and in particular, to an exhaust window assembly and a cooking device.

BACKGROUND

In existing air fryers, the housing is generally provided inside with a heat dissipation passage, and the rear lid of the housing is mounted with an exhaust window. Air in the heat dissipation passage is discharged via the exhaust window so as to dissipate heat and cool down parts such as the electric motor inside the housing. At the same time, high temperature gas in the cooking chamber can also be discharged via the exhaust window, achieving hot air circulation in the cooking chamber. However, when placing the air fryer, the exhaust window can very easily be too close to a wall. As gas discharged via the exhaust window has a high temperature, the wall can be easily damaged, and smooth discharge is hindered.

SUMMARY

Embodiments of a first aspect of the present application provide an exhaust window assembly for use in a cooking device. The exhaust window assembly comprises: an exhaust window body provided with first vents; and an exhaust window base connected to the exhaust window body, a part of the exhaust window base extending out of the exhaust window body, the first vents being distributed outside the exhaust window base.

Embodiments of a second aspect of the present application provide a cooking device, comprising: a housing which is provided with a mounting opening and inside which there is a heat dissipation passage; and an exhaust window assembly according to any one of the embodiments, the exhaust window body being arranged at the mounting opening, the heat dissipation passage being in communication with the first vents.

Additional aspects and/or advantages of the general idea of the present application will be set forth in part in the following description, and in part will be apparent from the description, or may be learned through implementation of the general idea of the present application.

DESCRIPTION OF THE DRAWINGS

The above and other objectives and features of the present application will become clearer from the description of embodiments in reference to the accompanying drawings, in which.

DESCRIPTION OF REFERENCES IN FIGS. 1 TO 19

Figure 1:
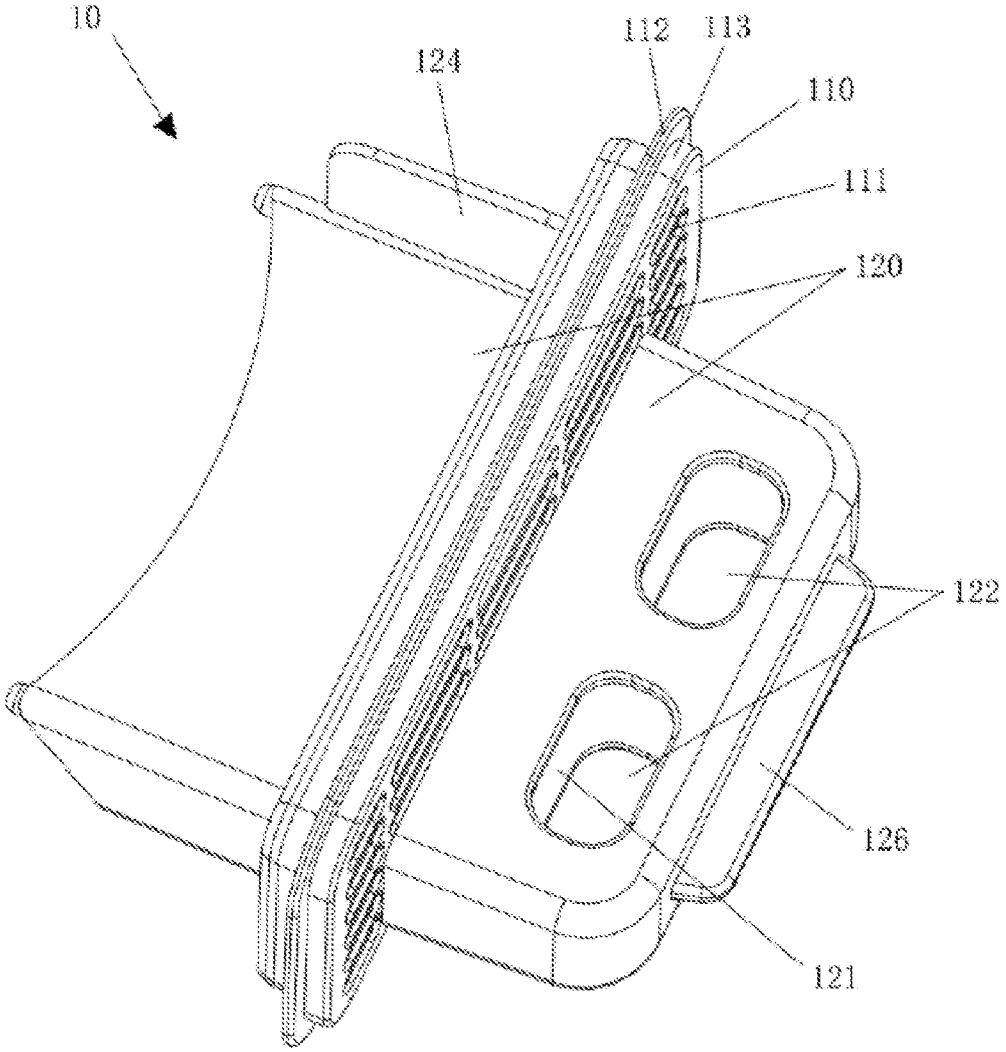
FIG. 1 shows a schematic structural view of an exhaust window assembly according to an embodiment of the present application.

10 exhaust window assembly,

110 exhaust window body, 111 first vent, 112 position limiting rib, 113 mounting notch,

120 exhaust window base, 121 venting passage, 122 second vent, 123 air inlet, 124 wind shield, 125 connecting structure, 1251 insertion part, 1252 threaded post, 126 rib, 127 flange

20 housing, 210 mounting opening, 220 housing rear lid, 230 housing base, 240 housing top lid, 250 housing side lid, 260 heat dissipating passage,

30 liner, 310 cooking chamber, 320 air outlet, 330 upper liner, 331 first insertion hole, 332 second insertion hole, 340 lower liner,

40 electric motor, 410 electric motor base,

50 heat dissipating blade,
60 wind guiding blade,
70 heating tube,
80 protective mesh,
90 inner pot assembly,
100 wall.

DETAILED DESCRIPTION OF THE EMBODIMENTS

The following detailed description of the embodiments is provided to assist the reader in gaining a comprehensive understanding of the methods, devices, and/or systems described herein. However, various alterations, modifications, and equivalents of the methods, devices, and/or systems described herein will be apparent upon understanding the disclosure of the present application. For example, the sequences of operations described herein are examples only and are not limited to those sequences set forth herein. Rather, other than operations that must occur in a specific order, changes can be made as will be apparent upon understanding the disclosure of the present application. Furthermore, description of features known in the art may be omitted for greater clarity and conciseness.

Features described herein may be implemented in different forms and should not be construed as being limited to the examples described herein. Rather, the examples described herein have been provided to illustrate only some of the many possible ways of implementing the methods, devices and/or systems described herein, which will be apparent upon understanding the disclosure of the present application.

As used herein, the term "and/or" includes any one of, and any combination of two or more of, the associated listed items.

Although terms such as "first," "second" and "third" may be used herein to describe various members, components, regions, layers or sections, these members, components, regions, layers or sections should not be limited by these terms. Rather, these terms are only used to distinguish one member, component, region, layer or section from another member, component, region, layer or section. Thus, what is referred to as a first member, first component, first region, first layer or first section in the examples described herein could also be referred to a second member, second component, second region, second layer or second section without departing from the teachings of the examples.

In the specification, when an element such as a layer, region or substrate is described as being "on," "connected to" or "coupled to" another element, the element can be directly "on" the other element, directly "connected to" or "coupled to" the other element, or there may be one or more other elements between them. In contrast, when an element is described as being "directly on," "directly connected to" or "directly coupled to" another element, there may be no elements between them.

The terms used herein are used only to describe various examples and are not intended to limit the disclosure. The singular forms are intended to include the plural forms as well, unless the context clearly indicates otherwise. The terms "comprise," "include," and "have" indicate the presence of recited features, quantities, operations, components, elements and/or combinations thereof, but do not exclude the presence or addition of one or more other features, quantities, operations, components, elements and/or combinations thereof. The term "a plurality of/multiple" means any number of two and more than two.

The definitions of positional words such as "above," "below," "top" and "bottom" in the present application are based on the position of a product under normal use, unless it is specified that they are based on illustrated positions.

Unless otherwise defined, all terms, including technical and scientific terms, used herein have the same meanings as commonly understood by one of ordinary skill in the art to which the present application belongs after understanding the present application. Unless expressly so defined herein, terms defined in general dictionaries should be construed to have a meaning consistent with their meaning in the context of the relevant art and in the present application, and should not be idealized or overly formally explained.

The terms "front side" and "rear side" in the present application are based on the orientation of a user facing the front of a product when the product is in normal use. The direction closer to the user is the front and the direction away from the user is the rear. By default, the front-rear direction is the same direction as the length direction of the product. Similarly, the left and right sides are also based on the orientation of the user facing the front of the product when the product is in normal use. By default, the left-right direction is the same direction as the width direction of the product. In the following description of the exhaust window assembly 10, to facilitate the description of the exhaust window assembly 10, the length direction and width direction of the exhaust window assembly 10 are the same directions as the length and width directions of the product, respectively, instead of taking whichever direction of the exhaust window assembly 10 itself is actually the longest as the length direction.

Below, an exhaust window assembly 10 and a cooking device provided by embodiments of the present application will be described in reference to FIGS. 1 to 16.

Figure 2:
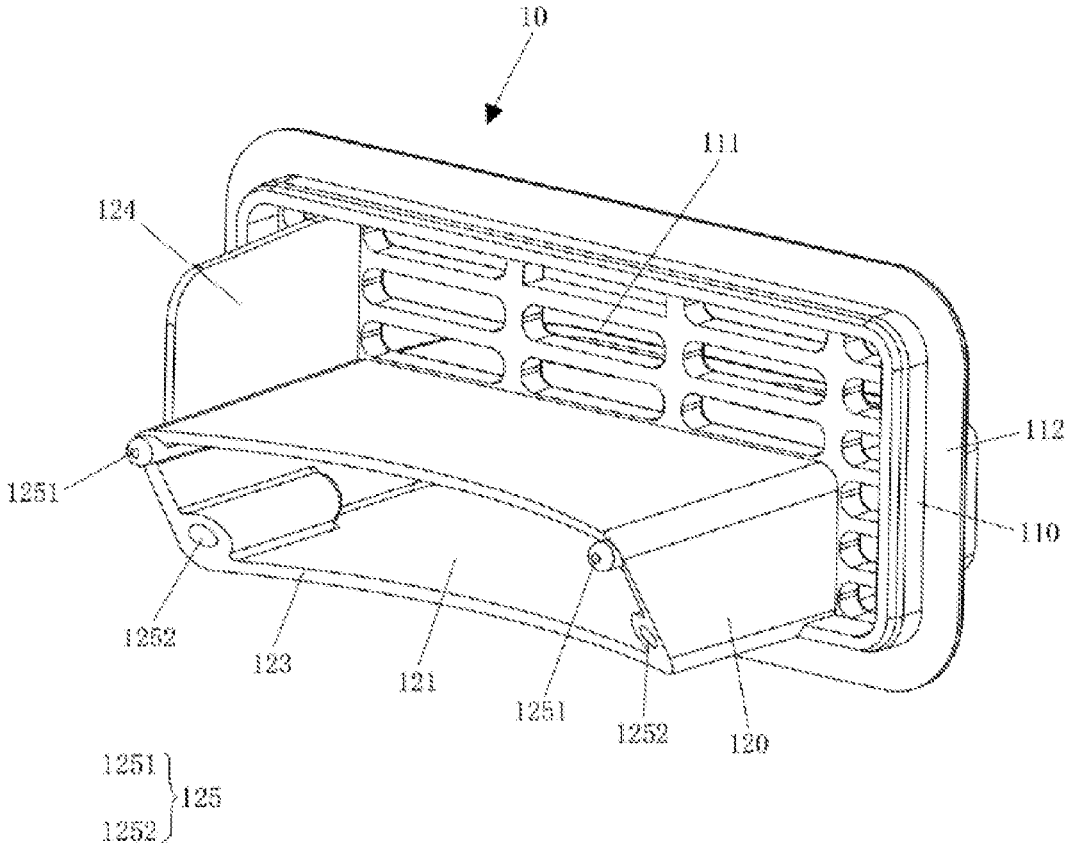
FIG. 2 shows a schematic structural view of the inner side of an exhaust window assembly according to an embodiment of the present application.
Figure 3:
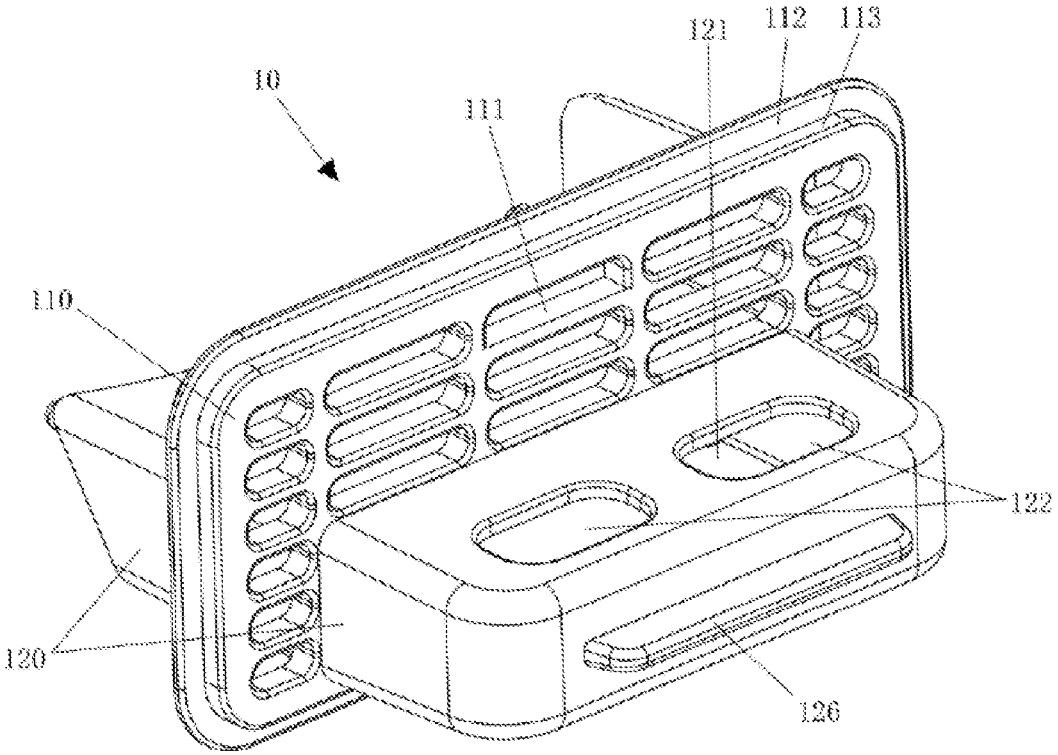
FIG. 3 shows a schematic structural view of the outer side of an exhaust window assembly according to an embodiment of the present application.
Figure 4:
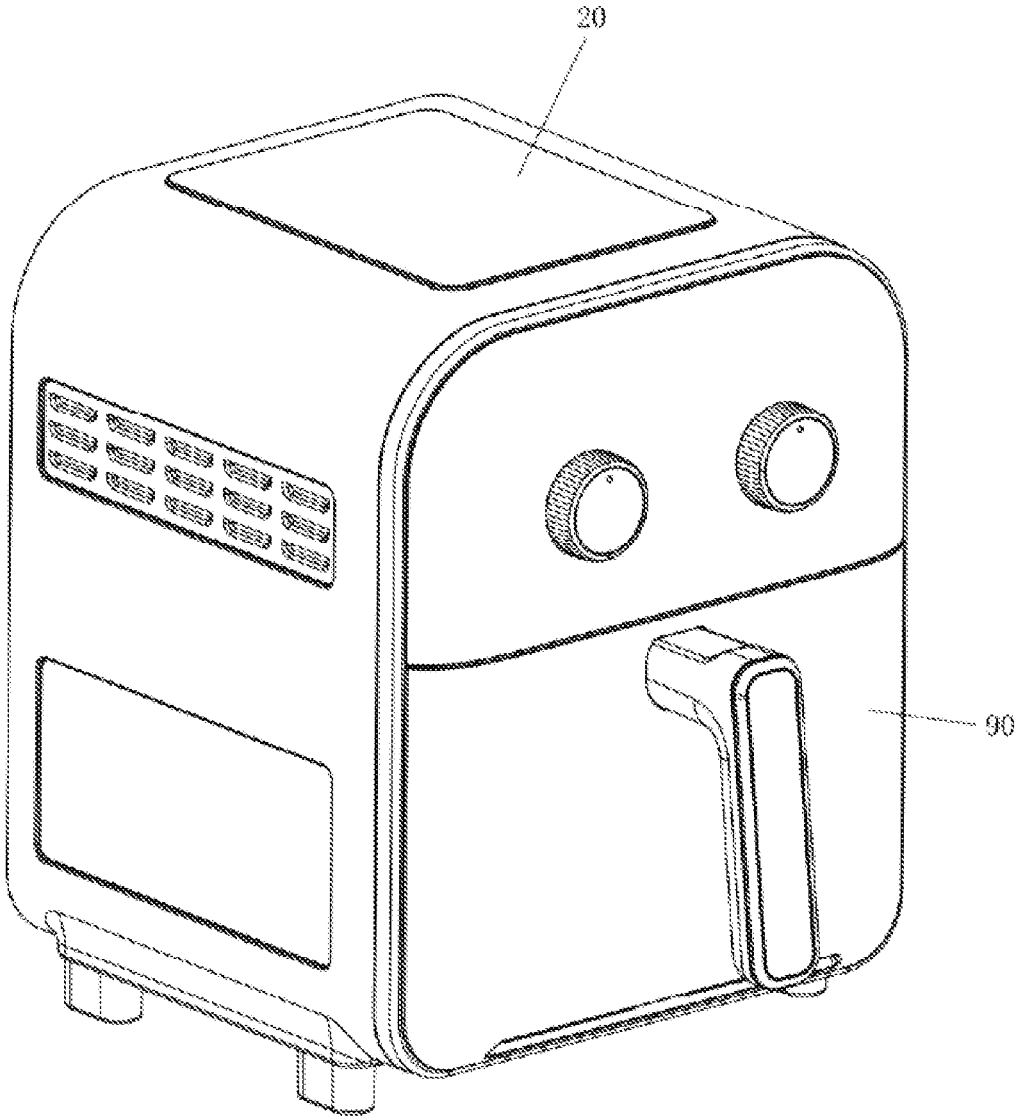
FIG. 4 shows a schematic structural view of a cooking device according to an embodiment of the present application.

As shown in FIGS. 1, 2, and 3, an embodiment according to a first aspect of the present application provides an exhaust window assembly 10 used for a cooking device. The exhaust window assembly 10 comprises: an exhaust window body 110 provided with first vents 111; an exhaust window base 120 connected to the exhaust window body 110, a part of which extends out of the exhaust window body 110. The first vents 111 are distributed outside the exhaust window base 120.

The exhaust window assembly 10 provided by the embodiment of the present aspect comprises an exhaust window body 110 and an exhaust window base 120, with a part of the exhaust window base 120 extending out of the exhaust window body 110, which helps use the part of the exhaust window base 120 located at the outer side of the exhaust window body 110 to separate the exhaust window body 110 and a wall so that there remains a certain heat dissipating space between the exhaust window body 110 and the wall, thereby on one hand, preventing gas discharged from the exhaust window body 110 from damaging the wall, and on another hand, allowing gas discharged from the exhaust window body 110 to smoothly enter the heat dissipating space and then disperse, improving heat dissipating efficiency.

In addition, the part of the exhaust window base 120 located at the outer side of the exhaust window body 110 can serve as a handle for a user to hold to move the cooking device. For example, a user holds a handle of an inner pot assembly 90 at the front side of the cooking device in one hand and the exhaust window base 120 in the other hand, which facilitates a stable movement of the cooking device.

It should be noted that, in the present application, by "a part of the exhaust window base 120 extends out of the exhaust window body 110", it means by default that a part of the exhaust window base 120 is located at the outer side of the exhaust window body 110, and a part is located at the inner side of the exhaust window body 110. The outer side of the exhaust window body 110 means the side at which gas is discharged from the exhaust window body 110, that is, the side of the exhaust window body 110 oriented towards the exterior when it is used in a cooking device. The inner side of the exhaust window body 110 means the side at which gas is admitted into the exhaust window body 110.

Further, in some embodiments, as shown in FIGS. 1, 2, and 3, in the exhaust window base 120 there is a venting passage 121, an end of which is used for communicating with a cooking chamber 310 of the cooking device. The part of the exhaust window base 120 located at the outer side of the exhaust window body 110 is provided with second vents 122. The other end of the venting passage 121 is in communication with the second vents 122.

In these embodiments, there is a venting passage 121 inside the exhaust window base 120. When the exhaust window assembly 10 is used in a cooking device, as illustrated in FIGS. 13, 14, 15, and 16, an end of the venting passage 121 is put in communication with a cooking chamber 310 of the cooking device, while the other end is in communication with second vents 122 located at the outer side of the exhaust window body 110, which helps directly discharge high temperature gas in the cooking chamber 310 to the exterior via the exhaust window base 120. On one hand, hot air circulation in the cooking chamber 310 is achieved, ensuring the heating effect. On the other hand, the likelihood that high temperature gas in the cooking chamber 310 leaks into the housing 20 is reduced. When combined with the fact that the first vents 111 are distributed outside the exhaust window base 120, high temperature gas discharged from the inside of the cooking chamber 310 and low temperature gas in the heat dissipating passage 260 of the cooking device can be discharged respectively from different vents. For example, high temperature gas in the cooking chamber 310 can be discharged from the second vents 122 on the exhaust window base 120, while low temperature gas in the heat dissipating passage 260 of the cooking device is discharged from the first vents 111 on the exhaust window body 110, which avoids interference between the two gases.

In a specific application, gas discharged from the cooking chamber 310 is heated, high temperature gas, whereas gas discharged from the heat dissipating passage 260 is low temperature gas. The temperature of the gas discharged from the cooking chamber 310 is generally higher than that of the gas discharged from the heat dissipating passage 260. The temperature of the gas discharged from the heat dissipating passage 260 is generally higher than the ambient temperature.

In a specific application, the first vents 111 are located above the exhaust window base 120, or the first vents 111 are located above the exhaust window base 120 and at two, left and right, sides of the exhaust window base 120.

Of course, the exhaust window body 110 can be further provided with third vents (not illustrated), which are arranged inside the exhaust window base 120, that is, inside the venting passage 121, so that high temperature gas in the cooking chamber 310 is discharged to the exterior via the venting passage 121, the third vents, and the second vents 122.

As an example, as shown in FIGS. 1, 2, and 3, the exhaust window base 120 is of a box-shape structure enclosing the venting passage 121. The box-shape structure is provided, at its end at the inner side of the exhaust window body 110, with an air inlet 123 used for communicating with the cooking chamber 310. The structure is simple and easy to process.

Regarding the position where the second vents 122 are arranged, in some embodiments, as shown in FIGS. 1 and 3, the second vents 122 are arranged in the upper surface and/or lower surface of the exhaust window base 120. Thus, high temperature gas in the cooking chamber 310, when discharged, will not directly hit a wall, reducing the likelihood of damaging the wall. In addition, when combined with the fact that the first vents 111 are distributed outside the exhaust window base 120, high temperature gas discharged from the second vents 122, after flowing through the first vents 111, can be mixed with gas at a lower temperature discharged from the first vents 111 and cool down, which increases safety and further reduces the likelihood of damaging the wall. In addition, when the second vents 122 are arranged at the upper and lower surfaces of the exhaust window base 120, on one hand, the area of vents can be increased, increasing hot air circulation efficiency, and on the other hand, heat exchange between exterior cold air flowing through the second vents 122 and high temperature gas is facilitated, thereby helping the high temperature gas cool down rapidly and then disperse.

As an example, as shown in FIGS. 1 and 3, the second vents 122 are distributed in a corresponding manner in the upper surface and lower surface of the exhaust window base 120. The venting effect is good, and the heat dissipating effect is good. In addition, heat exchange between exterior cold air flowing through the second vents 122 and high temperature gas is facilitated, thus helping high temperature rapidly cool down before dispersing, increasing safety, and reducing the impact on the wall.

In some embodiments, the second vents 122 are arranged at two sides of the width direction of the exhaust window base 120. Thus, high temperature gas in the cooking chamber 310, when discharged, will not directly hit a wall, reducing the likelihood of damaging the wall.

As an example, the second vents 122 are distributed in an opposite manner at the two sides of the width direction of the exhaust window base 120. The venting effect is good, and the heat dissipating effect is good.

Further, in some embodiments, as shown in FIGS. 1, 2, and 3, the exhaust window base 120 is arranged to be close to a lower edge of the exhaust window body 110. Thus, all or most of the first vents 111 on the exhaust window body 110 are located above the second vents 122. As hot air will rise, most of high temperature gas discharged from the second vents 122 will flow through the first vents 111 to disperse, which helps the high temperature gas exchange heat with low temperature gas discharged from the first vents 111 to cool down. Thus, the impact of high temperature gas on the wall can be effectively reduced, and safety is increased.

Further, in some embodiments, as shown in FIGS. 1 and 2, an outer surface of the exhaust window base 120 is provided with a wind shield 124 located at the inner side of the exhaust window body 110 and used for guiding wind to the first vents 111. Heat dissipating efficiency is increased.

Figure 11:
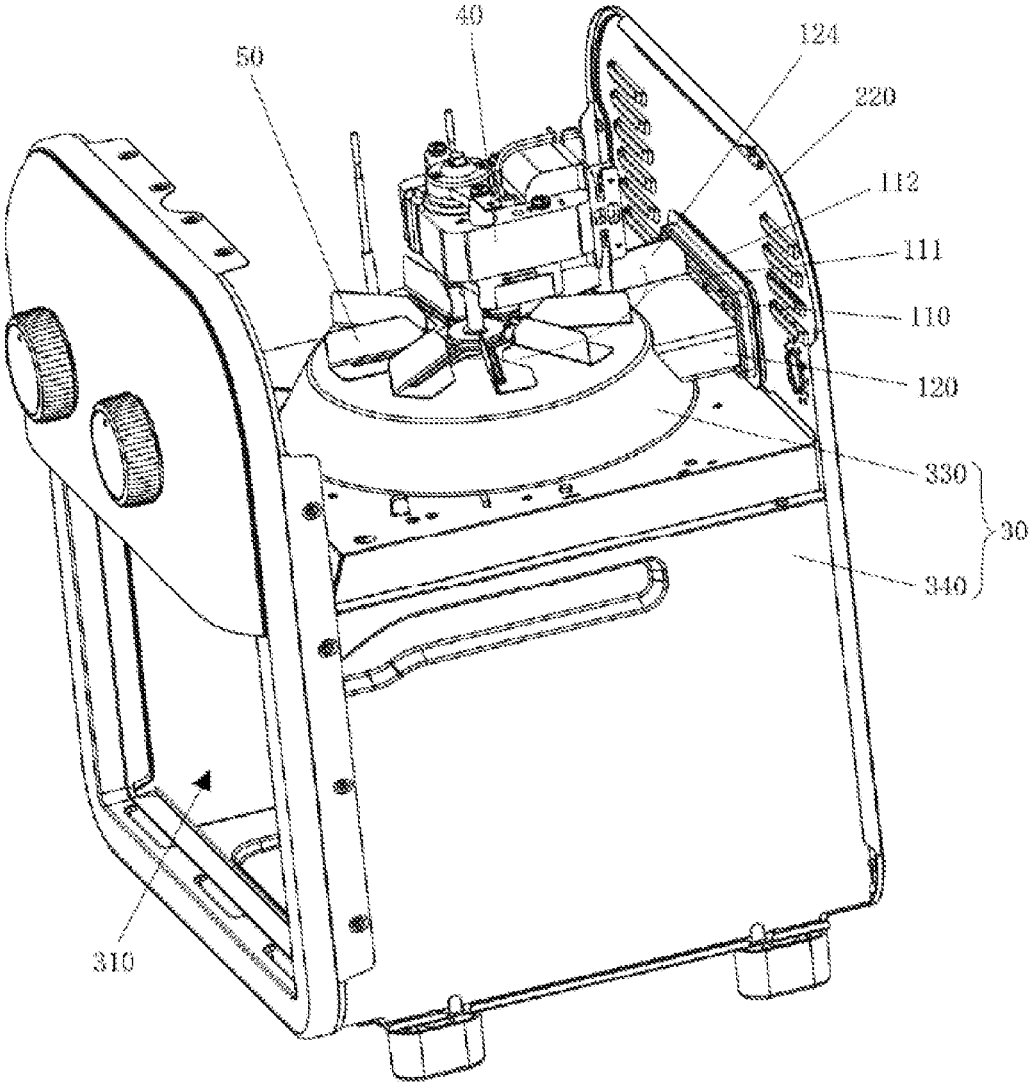
FIG. 11 shows a schematic structural view of the inside of a cooking device according to an embodiment of the present application with part of the housing hidden.

In a specific application, when the exhaust window assembly 10 is used in a cooking device, there is a heat dissipating blade 50 used for blowing gas towards the exhaust window base 120 in the heat dissipating passage 260 of the cooking device. In this case, the wind shield 124 can be arranged at the side of the exhaust window base 120 in the rotation direction of the heat dissipating blade 50, so that the first vents 111 are located at the windward side of the wind shield 124. Gas, after being blown to the wind shield 124, can flow towards the first vents 111 along the wind shield 124. The direction of the arrow in FIG. 11 represents the direction of flow of gas in the heat dissipating passage 260. In reference to FIG. 11, the rotation direction of the heat dissipating blade 50 is shown to be counter-clockwise and can drive gas to be blown towards the first vents 111 and the wind shield 124, so that a wind pressure is formed at the wind shield 124 causing a flow towards the first vents 111, guiding gas to flow out of the first vents 111.

In a specific application, as shown in FIGS. 1 and 2, the wind shield 124 is vertically arranged on the exhaust window base 120 and is connected to the inner surface of the exhaust window body 110, which increases the stability of the wind shield 124.

Further, in some embodiments, the length of the part of the exhaust window base 120 located at the outer side of the exhaust window body 110 is 25 mm or more. Thus, the distance between the exhaust window body 110 and a wall can be 25 mm or more, which makes it possible to keep a sufficient heat dissipating space between the exhaust window body 110 and the wall, preventing discharged gas from damaging the wall and preventing fires. In addition, it helps gas disperse after smoothly flowing out of the exhaust window body 110, which increases heat dissipating efficiency. Of course, it also helps a user hold the exhaust window base 120.

In a specific application, the length of the part of the exhaust window base 120 located at the outer side of the exhaust window body 110 is 30 mm or 35 mm. The exhaust window base 120 is arranged transversely on the exhaust window body 110. Processing is easy, and the structure is regular, with a good appearance.

Further, as shown in FIGS. 1 and 3, the exhaust window base 120 comprises a protruding rib 126 on its end located at the outer side of the exhaust window body 110 and away from the exhaust window body 110. The rib 126 can separate the exhaust window base 120 from a wall, which can prevent high temperature gas discharged from the second vents 122 from hitting the wall at a short distance. In addition, the rib 126 can further separate the exhaust window body 110 from the wall, preventing gas discharged from damaging the wall and preventing fires.

In addition, the sum of the protrusion length of the rib 126 and the length of the main body part of the exhaust window base 120 located at the outer side of the exhaust window body 110 is larger than or equal to 25 mm. Given the same length of the exhaust window base 120, the shortest distance between the exhaust window body 1110 and a wall can be adjusted by adjusting the length of the rib 126. Processing is easy, versatility of molds is good, and costs are saved.

In a specific application, to expand the volume of the cooking chamber 310, a part of the housing rear lid 220 of the housing 20 protrudes outward to form an extended cooking chamber 310, the volume of which is an enlarged volume of the cooking chamber 310. An end of the inner pot assembly 90 can be inserted into the extended cooking chamber 310 via the cooking chamber 310. As a part of the housing rear lid 220 protrudes outward, the housing rear lid 220 can very easily be too close to a wall. In this situation, the exhaust window base 120 can be provided with a rib 126 such that the protrusion length of the rib 126 in a horizontal direction is larger than or equal to the outer expansion length of the extended cooking chamber 310. Thus, given the same mold for the main body part of the exhaust window base 120, a rib 126 with an appropriate length is formed, which helps ensure that the housing rear lid 220 will not be too close to a wall and prevent the wall from being heated to a high temperature and causing a fire.

Figure 17:
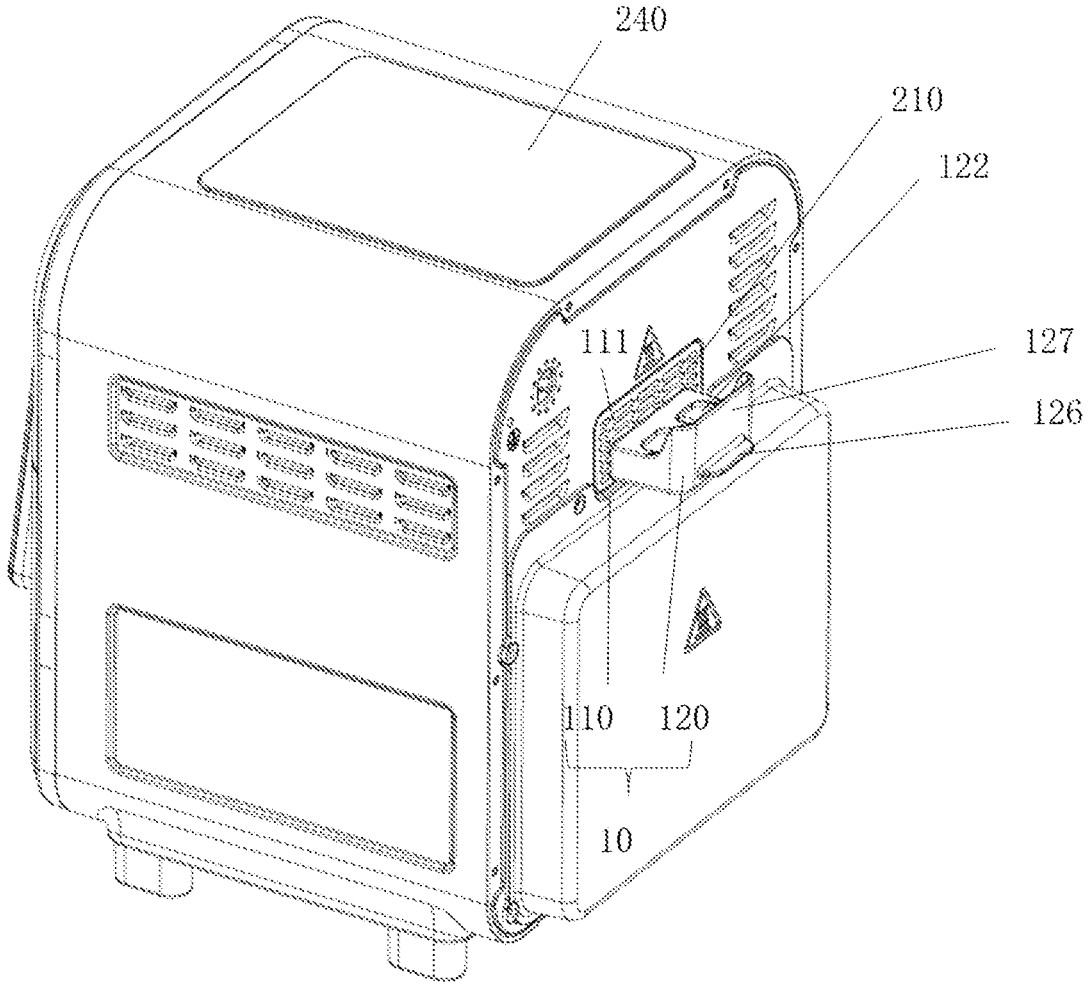
FIG. 17 shows a schematic view in perspective of a cooking device according to an embodiment of the present application.
Figure 18:
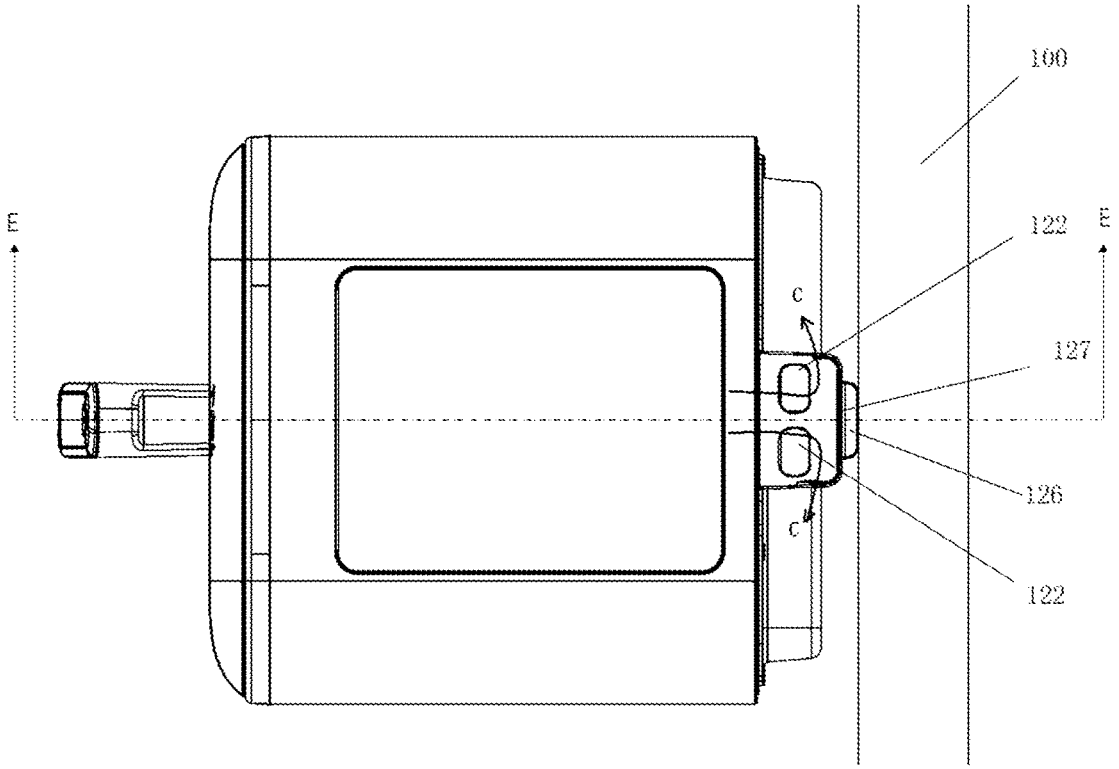
FIG. 18 shows a schematic top view of the cooking device in FIG. 17.
Figure 19:
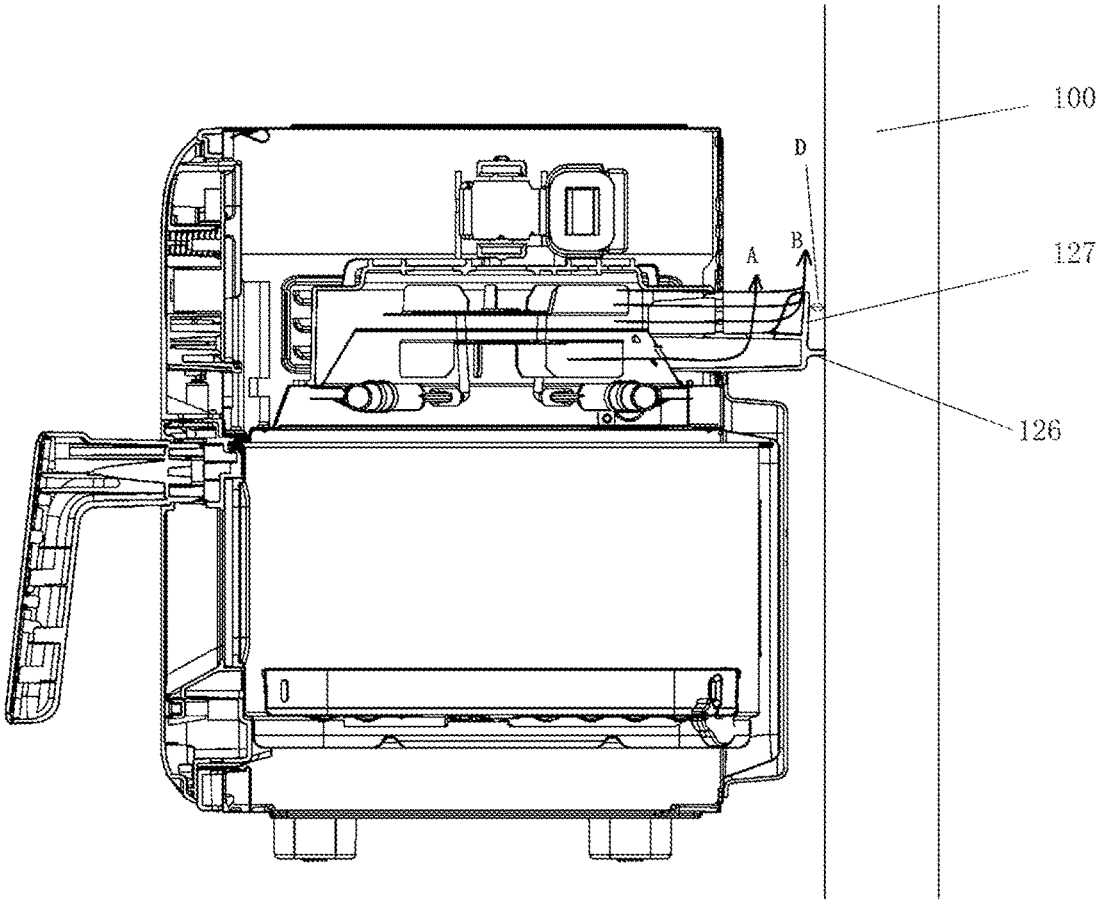
FIG. 19 shows a schematic sectional view in the direction E-E in FIG. 18.

Further, as shown in FIGS. 17 to 19, the part of the exhaust window base 120 located at the outer side of the exhaust window body 110 comprises a flange 127 extending upward vertically and arranged along its edge. The projection of the flange on a horizontal plane can be substantially of a U shape (cf. FIG. 18), the bottom wall of which is substantially parallel with the exhaust window body 110 and spaced apart from it, and two side walls of which are substantially perpendicular to the exhaust window body 110. Of course, the flange 127 can also be constituted by a single wall substantially parallel with the exhaust window body 110, and does not comprise the above-described two side walls. When in operation, high temperature gas in the cooking chamber 310 is discharged from the second vents 122 on the exhaust window base 120 (as shown by the arrow A in FIG. 19); low temperature gas in the heat dissipating passage 260 of the cooking device, after being discharged from the first vents 111 on the exhaust window body 110, will be stopped by the flange 127 and turn upward and/or to the two sides to be discharged (as shown by the arrow B in FIG. 19 and the arrow C in FIG. 18), instead of being directly blown towards the wall 100 and increasing its temperature, thereby reducing the likelihood of damaging the wall. When in use, advantageously, a certain distance D is maintained between the flange 127 and the wall 100 (in the presence of a rib 126, the distance is maintained by providing the rib 126 with an appropriate length; in the absence of a rib 126, the distance is maintained by placing the cooking device at an appropriate location). Preferably, the distance D is larger than or equal to 5 mm, which prevents hot air from being too close to the wall and increasing its temperature.

Further, in some embodiments, as show in FIGS. 1, 2, and 3, the exhaust window body 110 and the exhaust window base 120 are formed integrally. Compared to the prior art where the exhaust window body 110 and the exhaust window base 120 are separate structures and need to be assembled subsequently, processing is easy, production efficiency is high, connection is solid and reliable, and the number of connectors can be reduced, reducing costs of parts and costs of molds.

As shown in FIGS. 4, 5, 13, 14, 15, and 16, embodiments according to a second aspect of the present application provide a cooking device, comprising: a housing 20 provided with a mounting opening 210 and inside which there is a heat dissipation passage 260; an exhaust window assembly 10 according to any one of the preceding embodiments, the exhaust window body 110 being arranged at the mounting opening 210, the heat dissipation passage 260 being in communication with the first vents 111.

Because of the exhaust window assembly 10 according to any one of the preceding embodiments, the cooking device provided by the embodiments of the present aspect has the beneficial effects of any one of the preceding embodiments, which are not repeated here. In addition, gas in the heat dissipating passage 260 can be discharged via the first vents 111 on the exhaust window body 110, which facilitates heat dissipation.

In some embodiments, as shown in FIGS. 6, 7, 11, 12, 14, and 15, the cooking device further comprises a liner 30 arranged inside the housing 20. There is a cooking chamber 310 inside the liner 30. The top of the liner 30 is provided with an air outlet 320 that puts the cooking chamber 310 in communication with the venting passage 121 of the exhaust window assembly 10. Thus, high temperature air in the cooking chamber 310 can be discharged via the air outlet 320, the venting passage 121, and the second vents 122.

Figure 12:
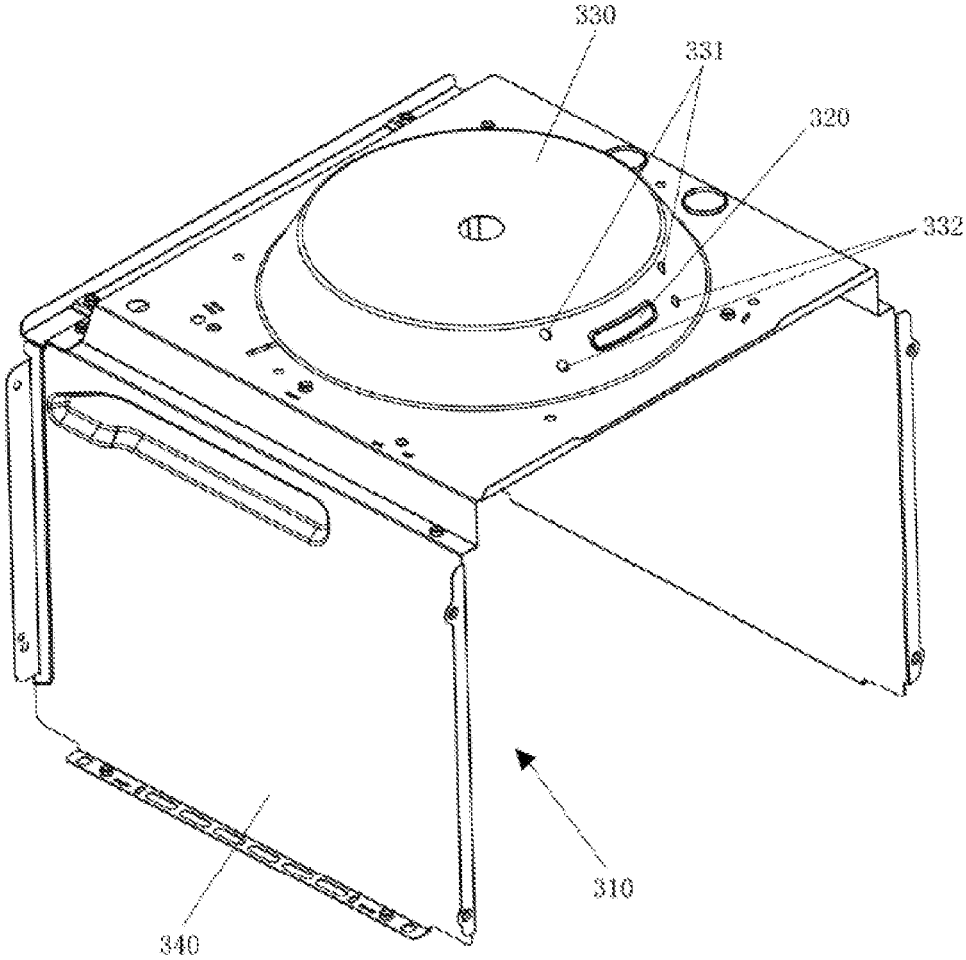
FIG. 12 shows a schematic structural view of a liner of a cooking device according to an embodiment of the present application.
Figure 13:
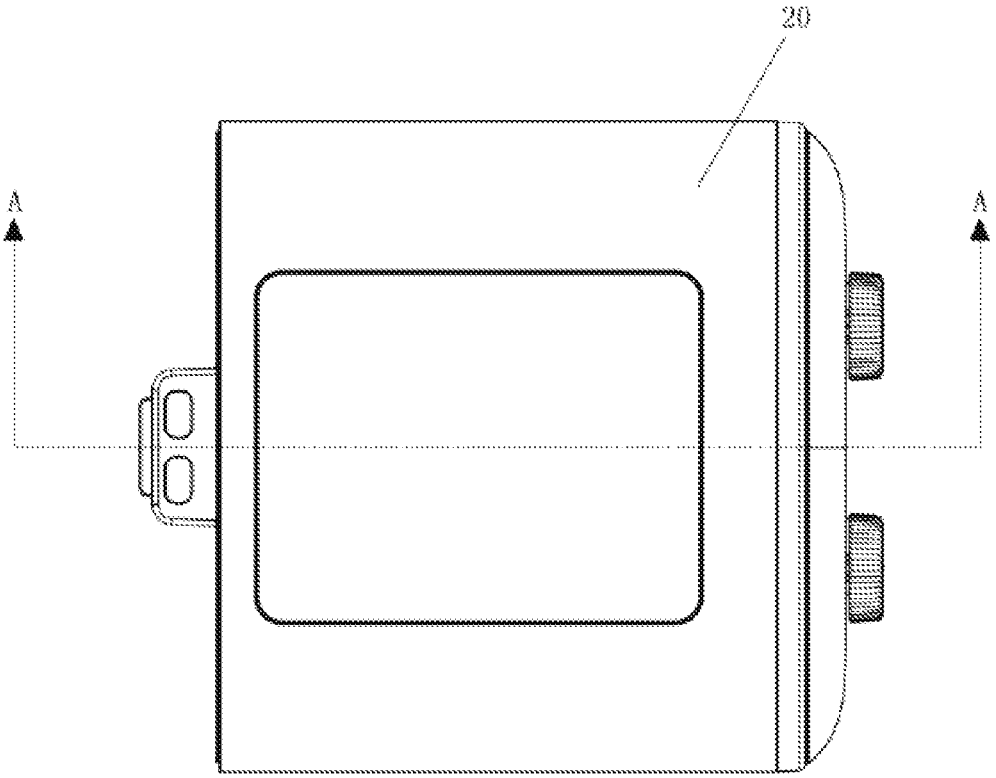
FIG. 13 shows a schematic top view of a cooking device according to an embodiment of the present application.

Further, as shown in FIG. 12, the liner 30 comprises a lower liner 340 and an upper liner 330 arranged at the top of the lower liner 340, the air outlet 320 being arranged at the upper liner 330.

Further, as shown in FIGS. 7, 9, 10, 11, and 12, the liner 30 comprises a liner top wall and liner side walls located at two sides in the width direction of the liner top wall. A housing rear lid 220 connects the two liner side walls from the rear, and together with the liner 30, encloses the cooking chamber 310. Since there is no side wall at the rear side of the liner 30, materials used are reduced and costs are saved.

Figure 5:
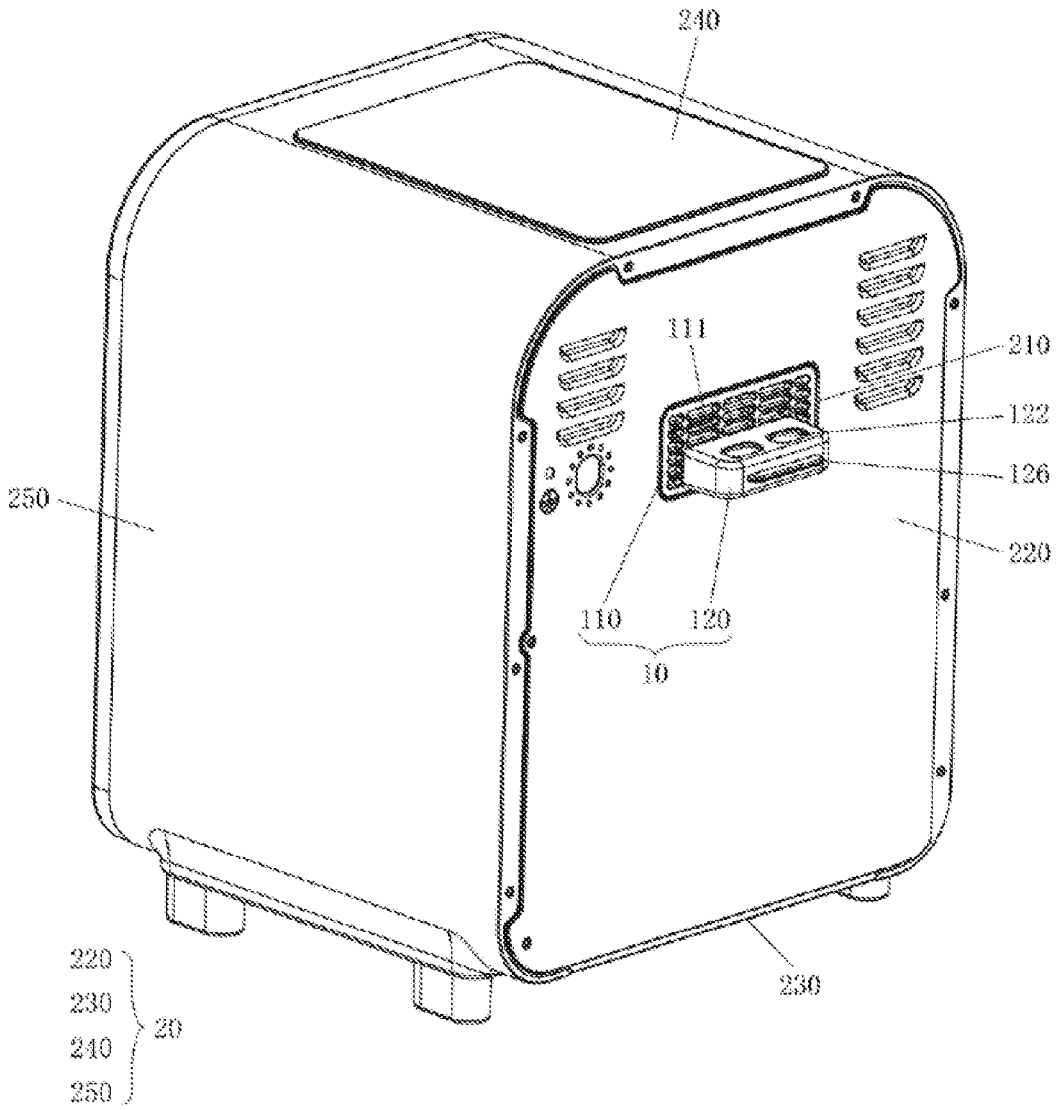
FIG. 5 shows a schematic structural view of the rear side of a cooking device according to an embodiment of the present application.
Figure 6:
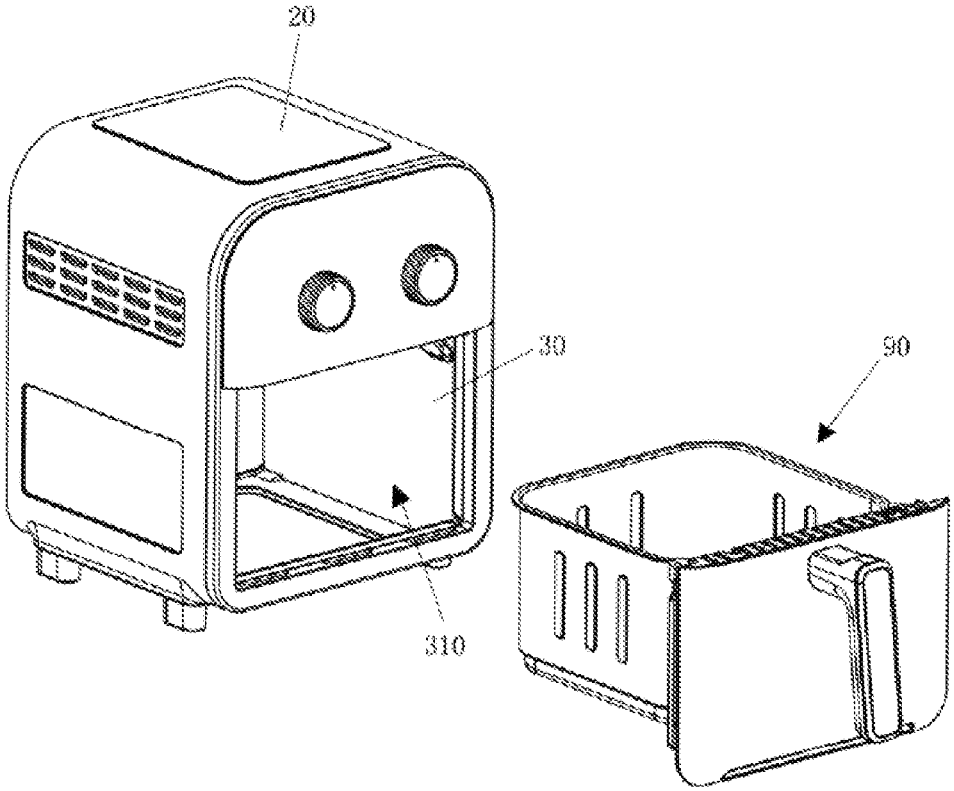
FIG. 6 is a schematic structural view of a cooking device according to an embodiment of the present application with the inner pot assembly removed.
Figure 7:
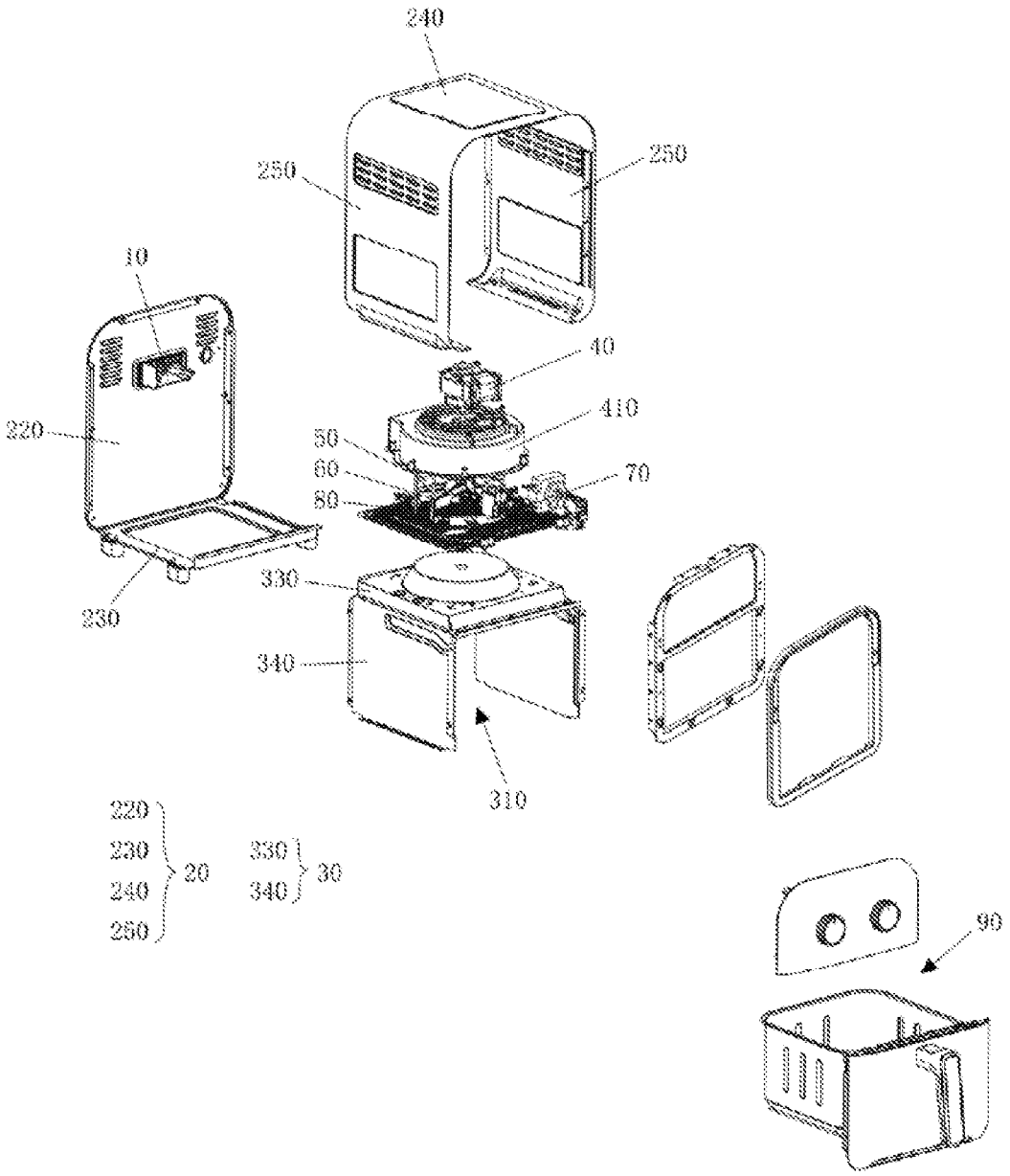
FIG. 7 shows a schematic exploded view of a cooking device according to an embodiment of the present application.

As an example, as shown in FIGS. 5 and 7, a part of the housing rear lid 220 opposite the liner 30 extends vertically, or protrudes outward to form an extended cooking chamber 310 (not illustrated). The housing rear lid 220 can have different shapes that allow the housing rear lid 220 and the liner 30 to cooperate to enclose together the cooking chamber 310. An accommodating chamber of different volumes can be realized without changing the liner 30 and other parts of the housing 20. Thus, it helps accommodate an inner pot assembly 90 of different volumes by means of the accommodating chamber, realizing a cooking device that has different volumes and good versatility.

As an example, in the event that a part of the housing rear lid 220 opposite the liner 30 protrudes outward to form an extended cooking chamber 310, the extension length of the extended cooking chamber 310 is smaller than or equal to the protrusion length of the rib 126 of the exhaust window assembly 10 in a horizontal direction. Specifically, by arranging a rib 126 at an end of the exhaust window base 120 at the outer side of the exhaust window body 110 and away from the exhaust window body 110 and providing that the protrusion length of the rib 126 in a horizontal direction is larger than or equal to the extension length of the extended cooking chamber 310, it can be prevented that the distance between the housing rear lid 220 and a wall is too short and a fire occurs due to the wall being overheated.

Figure 14:
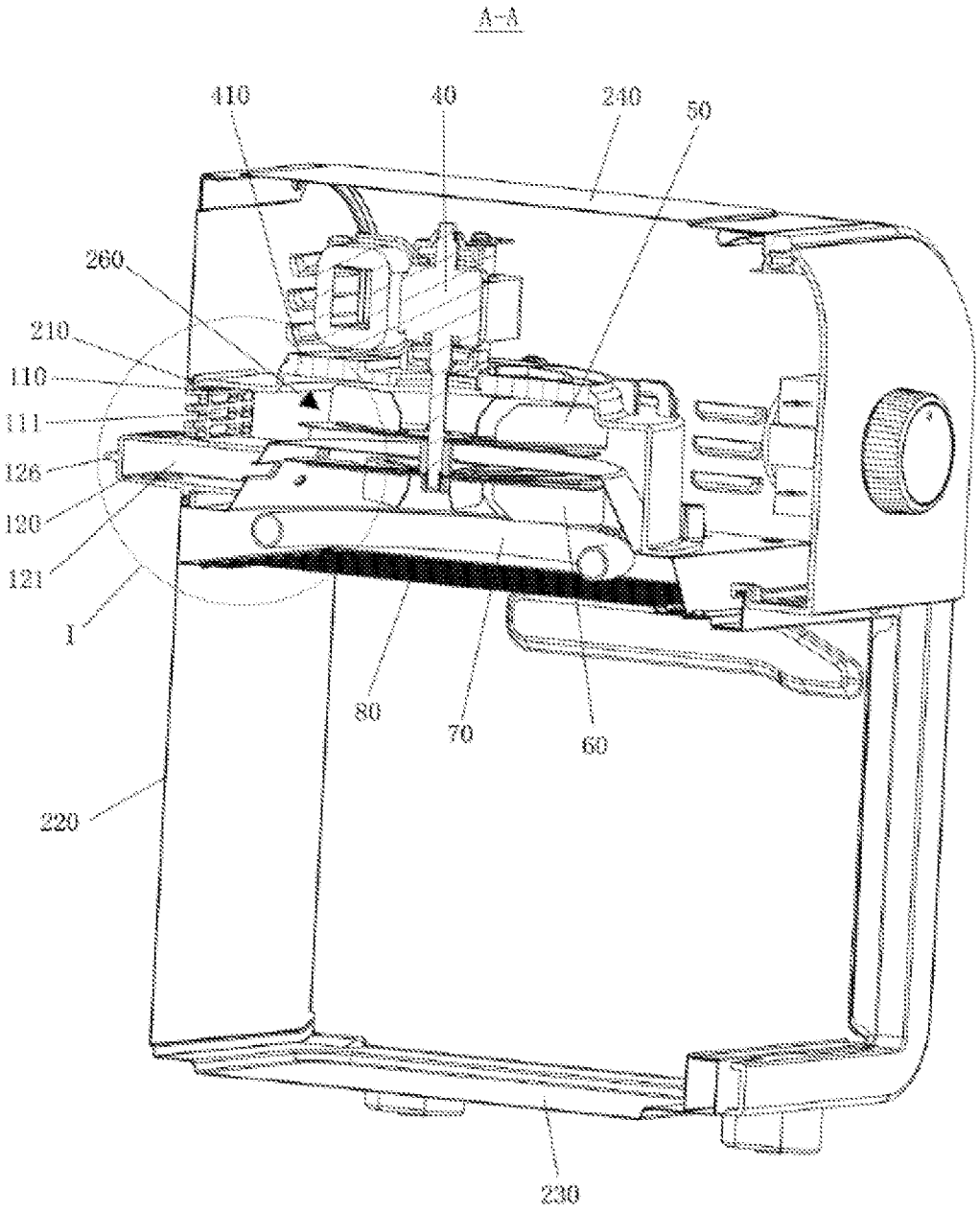
FIG. 14 shows a schematic sectional view along the direction A-A in FIG. 13.
Figure 15:
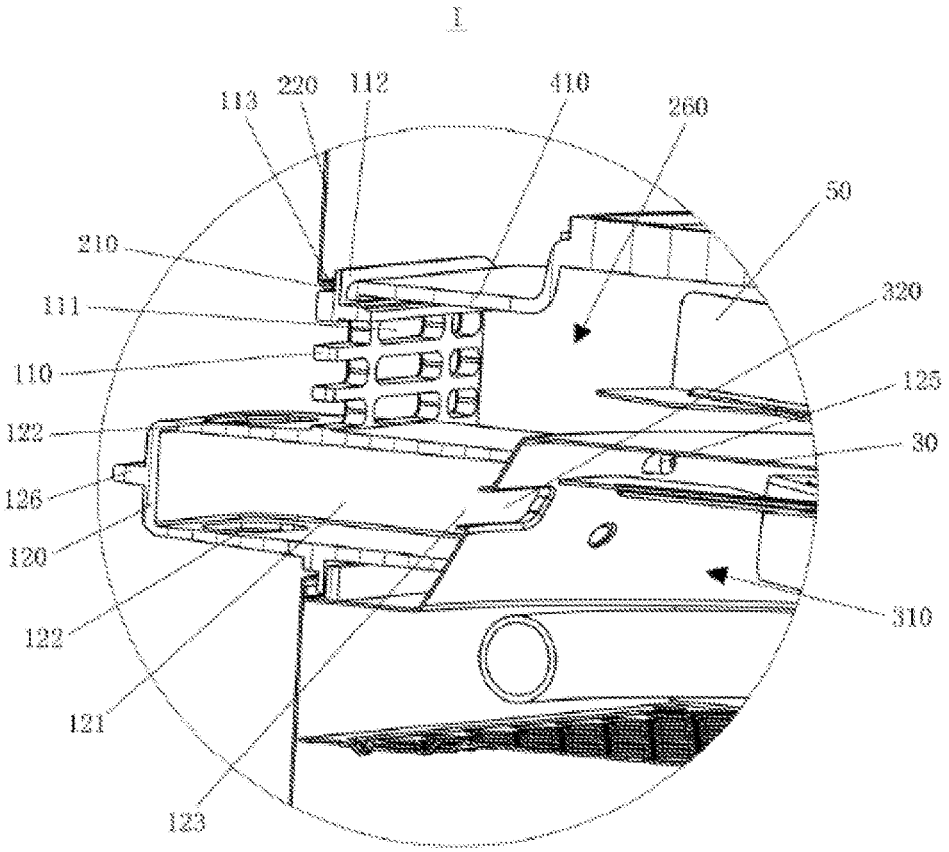
FIG. 15 shows a partial, schematic enlarged view of part I in FIG. 14.

Further, as shown in FIGS. 14 and 15, the heat dissipating passage 260 is located at the outer side of the liner 30 and the inner side of the housing 20.

In a specific application, as shown in FIGS. 7, 9, 10, 11, 14, and 15, the cooking device further comprises an electric motor base 410, an electric motor 40 arranged at the electric motor base 410, a heat dissipating blade 50, a wind guiding blade 60, a heating tube 70, a protective mesh 80, and an inner pot assembly 90. The electric motor 40 and the electric motor base 410 are arranged inside the heat dissipating passage 260. The heat dissipating blade 50 is arranged in the heat dissipating passage 260. The electric motor 40 drives the heat dissipating blade 50 to rotate so as to blow low temperature gas in the heat dissipating passage 260 towards the first vents 111, which takes away heat of the electric motor 40 and can dissipate heat from parts such as the electric motor 40 and the housing 20. The wind guiding blade 60 and the heating tube 70 are arranged at the top inside the cooking chamber 310. The wind guiding blade 60 is connected to an output shaft of the electric motor 40 that extends into the liner 30. The window guiding blade 60 rotates to blow heat produced by the heating tube 70 into the inner pot assembly 90 so as to heat a food material in the inner pot assembly 90. The protective mesh 80 is arranged in the liner 30 and located below the heating tube 70, and, in the event that the inner pot assembly 90 is placed in the cooking chamber 310, above the inner pot assembly 90. It, on one hand, can block grease and prevent a large amount of grease from sticking to the heating tube 70, and on another hand, prevents a user from touching the heating tube 70 by accident.

Figure 8:
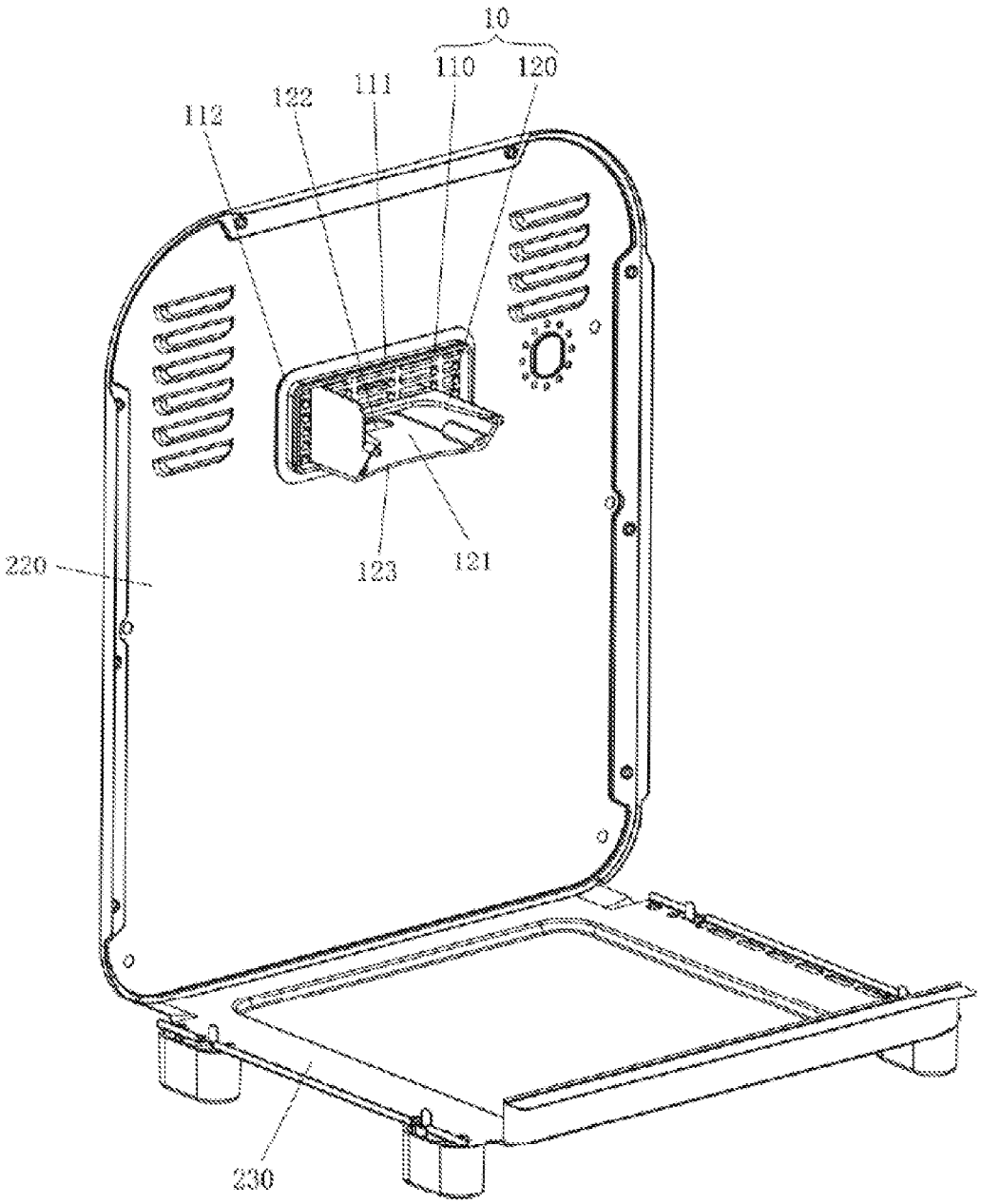
FIG. 8 shows a partial, schematic structural view of a housing when mounted together with an exhaust window assembly according to an embodiment of the present application.
Figure 9:
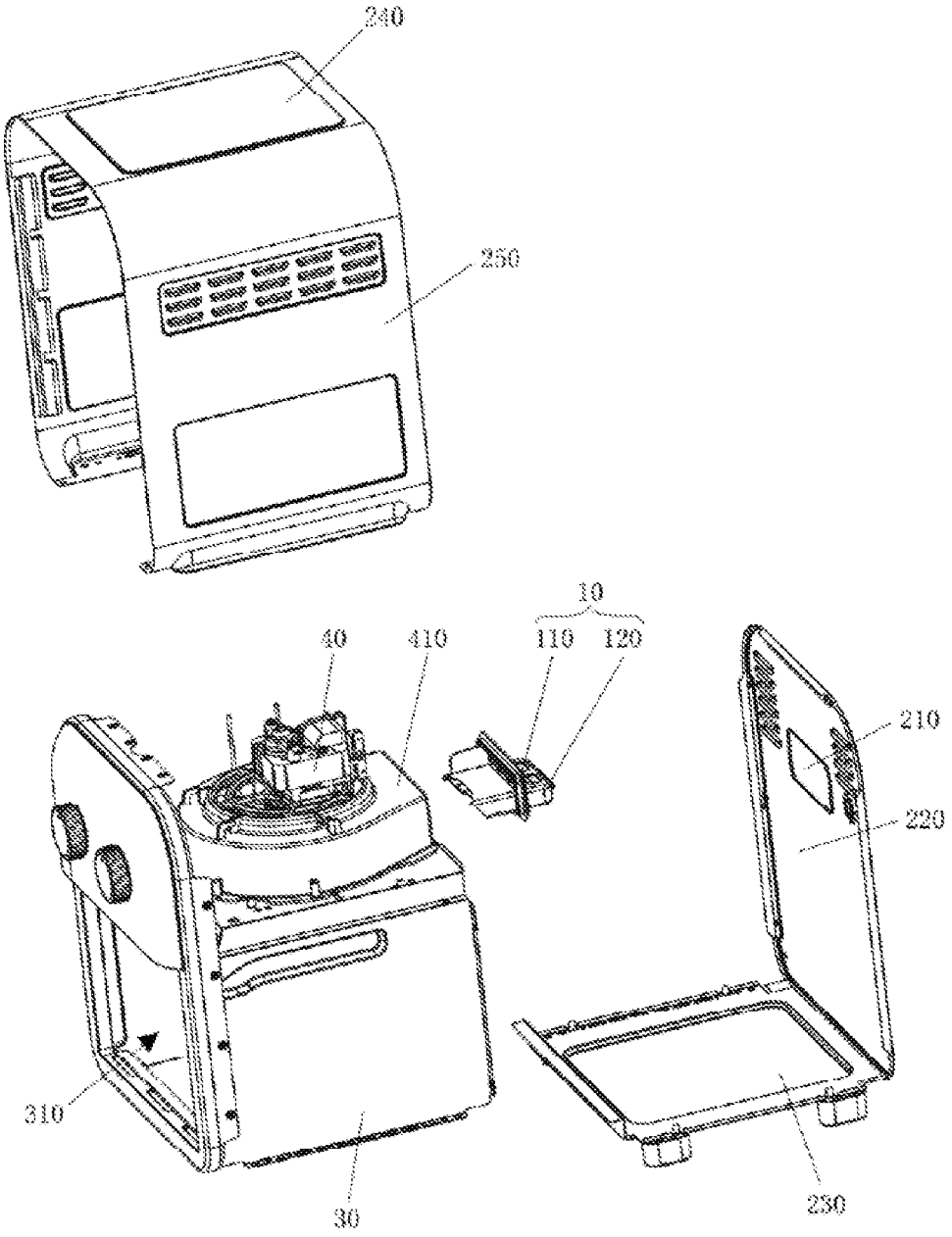
FIG. 9 shows a schematic view of a cooking device partially disassembled according to an embodiment of the present application.

Further, in some embodiments, as shown in FIGS. 5, 7, and 8, the housing 20 comprises a housing rear lid 220 at which a mounting opening 210 arranged. Thus, the exhaust window assembly 10 is mounted at the rear side of the housing 20. Venting is done from the rear, preventing high temperature gas from scalding a user when discharged.

As an example, as shown in FIG. 7, the housing 20 further comprises a housing base 230, a housing top lid 240, and housing side lids 250 located at two sides of the width direction of the housing top lid 240. The housing base 230 and the housing rear lid 220 are of an integral structure, and the housing top lid 240 and the housing side lids 250 located at two sides of the width direction of the housing top lid 240 are of an integral structure, which helps simplify assembly steps and increase assembly efficiency.

Regarding the mode of connection between the exhaust window assembly 10 and the mounting opening 210, further, in some embodiments, as shown in FIGS. 1, 3, 5, 8, and 15, the exhaust window body 110 is provided at its outer peripheral face with a position limiting rib 112. An end face of the position limiting rib 112 oriented towards the outer side and the outer peripheral face of the exhaust window body 110 form a mounting notch 113. An edge of the mounting opening 210 is embedded in the mounting notch 113 at the outer periphery of the exhaust window assembly 10. Rapid and accurate connection to position between the exhaust window assembly 10 and the housing 20 is facilitated.

Further, the mounting notch 113 is clearance fitted with the edge of the mounting opening 210.

Figure 10:
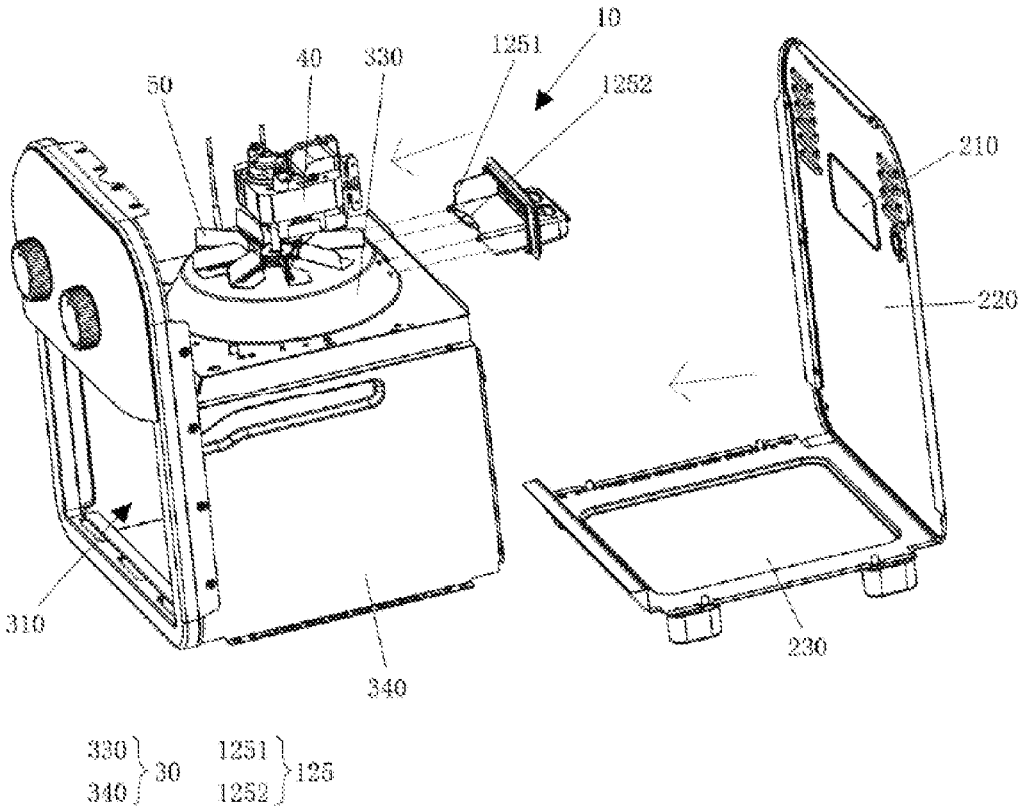
FIG. 10 shows an assembly process diagram of an exhaust window assembly of a cooking device according to an embodiment of the present application.

In a specific application, the exhaust window assembly 10 is assembled with the mounting opening 210 from the inner side of the housing 20. Specifically, the directions of the arrows in FIG. 10 represent the directions of mounting the exhaust window assembly 10 and the housing rear lid 220. In reference to FIG. 10, first the exhaust window assembly 10 can be mounted on the liner 30 along the direction of the arrow on the top, and then the housing rear lid 220 and the housing base 230 are mounted along the direction of the arrow at the bottom, and the mounting opening 210 is aligned with the position of the mounting notch 113 and inserted therein. After being mounted together, in reference to FIGS. 14 and 15, the housing rear lid 220 and the exhaust window body 110 are clearance fitted, and an edge of the mounting opening 210 on the housing rear lid 220 presses against the position limiting rib 112 on the exhaust window body 110 to form a whole.

Regarding the mode of mounting the exhaust window assembly 10, further, in some embodiments, as shown in FIG. 2, an end of the exhaust window base 120 located at the inner side of the exhaust window body 110 has a connecting structure 125 used for mounting and positioning the exhaust window assembly 10.

Figure 16:
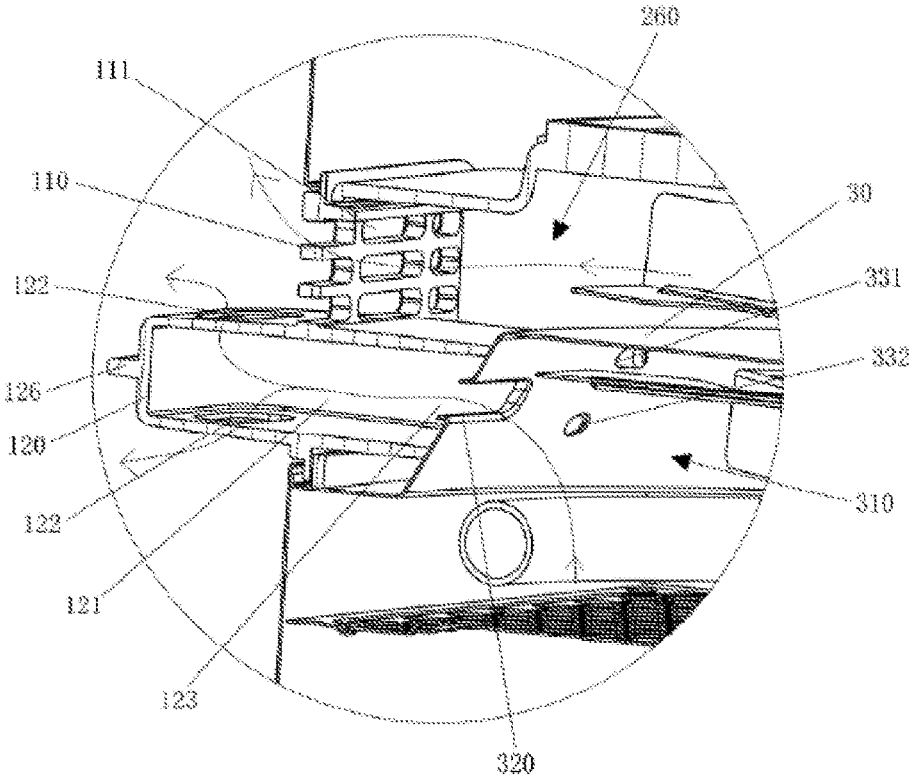
FIG. 16 shows a schematic view of a gas circulation path at I in FIG. 14.

Further, as shown in FIGS. 14, 15, and 16, the connecting structure 125 is connected to the periphery of the air outlet 320 in the liner 30. By connecting the connecting structure 125 to the liner 30 and using the connecting structure 125 for mounting and positioning the exhaust window assembly 10, the exhaust window assembly 10 as a whole is connected to the liner 30 by means of the connecting structure 125, without the need to be connected to the housing 20 of the cooking device. Thus, compared to the relevant art where a plurality of screws are arranged at the housing 20 to connect an exhaust window assembly 10, outward protrusion of screws is avoided, and the appearance is good. In reference to FIG. 5, the outer surface of the housing rear lid 220 has no screw used for connecting to the exhaust window assembly 10.

Further, in reference to FIG. 11, an end face of the end of the exhaust window base 120 located at the inner side of the exhaust window body 110 presses tightly against the outer surface of the liner 30. If the wall face at the periphery of the air outlet 320 in the liner 30 is an arc-shaped face, then the end face of the exhaust window base 120 located at the inner side of the exhaust window body 110 is also an arc-shaped face. On one hand, the sealing effect is good, and on the other hand, stable mounting of the exhaust window assembly 10 on the liner 30 is facilitated.

As an example, as shown in FIGS. 2, 10, 12, 14, 15, and 16, the connecting structure 125 comprises a plurality of insertion parts 1251 and a plurality of threaded posts 1252 that are distributed in a spaced apart manner in the circumferential direction of the venting passage 121. The wall face surrounding the air outlet 320 in the liner 30 is provided with a plurality of first insertion holes 331 distributed in a manner of corresponding to the plurality of insertion parts 1251 one by one, and a plurality of second insertion holes 332 distributed in a manner of corresponding to the plurality of threaded posts 1252 one by one. Each insertion part 1251 is inserted into a corresponding first insertion hole 331. Each screw passes through a second insertion hole 332 to be inserted into a corresponding threaded post 1252. The connection is strong, and compared to a connection that uses entirely screws, assembly time can be saved and assembly efficiency can be increased As an example, as shown in FIG. 2, the connecting structure 125 is located at the inner side of the venting passage 121. Of course, the connecting structure 125 can also be located at the outer side of the venting passage 121.

In reference to FIGS. 2, 10, 12, and 15, there are two insertion parts 1251, distributed at two sides of the width direction of the upper part of the air inlet 123 of the venting passage 121. There are two threaded posts, distributed at two sides of the width direction of the lower part of the air inlet 123 of the venting passage 121. The connecting structure 125 is arranged inside the venting passage 121 and avoids the air outlet 320 in the liner 30.

Further, the liner 30 is a metallic liner, and the housing 20 is a metallic housing.

A cooking device according to an embodiment of the present application is described below in detail. The cooking device is a fully metallic vertical air fryer mainly comprised of parts such as a liner 30, an exhaust window assembly 10, and a housing 20.

Four holes are provided at the top of the liner 30 at the rear side. The two upper holes are first insertion holes 331 used for cooperating with the exhaust window assembly 10 in a position-limiting manner, and specifically, for the inserting of insertion parts 1251 of the exhaust window assembly 10. The two lower holes are used for tightening and fixing the exhaust window assembly 10 by screws.

The exhaust window assembly 10 comprises an exhaust window body 110 and an exhaust window base 120 formed integrally. The exhaust window base 120 is arranged to be close to the lower edge of the exhaust window body 110. The upper surface and the lower surface of the exhaust window base 120 are provided in total with four high temperature air outlets (i.e., second vents 122), the four second vents 122 being located at the outer side of the exhaust window body 110. When combined with the fact that the exhaust window base 120 extends out of the exhaust window body 110 by at least 25 mm, it prevents a wall from being heated to a high temperature and causing a fire. In addition, air discharged from the four second vents 122 is prevented from coming into direct contact with the wall.

The exhaust window body 110 is provided with low temperature air outlets (i.e., first vents 111). A wind shield 124 is arranged at an upper part of the exhaust window base 120 and is able to form a wind pressure so as to discharge gas from the low temperature air outlets. When hot air discharged from the four high temperature air outlets passes through the low temperature air outlets, it can be effectively cooled down, ensuring safety.

The exhaust window base 120 extends at the outer side of the exhaust window body 110 by 25 mm or above. It can not only prevent a wall from being heated to a high temperature, but also serve as a handle which facilitating operations and movements.

A ring of depression (i.e., mounting notch 113) that is clearance fitted with and pressed against the housing rear lid 220 of the housing 20 is arranged at the periphery of the exhaust window body 110. A structure without screw on the surface of the housing rear lid 220 is achieved, which has multiple advantages such as being safe, aesthetic, highly resistant, and highly efficient in assembly.

Further, in some embodiments, the cooking device is an air fryer, a two-in-one air frying/baking device, etc.

Although embodiments of the present application have been described in detail above, those skilled in the art may make various modifications and variations to the embodiments of the present application without departing from the spirit and scope of the present application. It should be understood that, to those skilled in the art, these modifications and variations will still fall within the spirit and scope of the embodiments of the present application as defined by the claims.

What is claimed is:

1. An exhaust window assembly for use in a cooking device comprising:

an exhaust window body provided with first vents; and an exhaust window base connected to the exhaust window body, wherein a part of the exhaust window base extends out of the exhaust window body, the first vents being distributed outside the exhaust window base, wherein the exhaust window base comprises a venting passage having a first end and a second end, wherein the first end of the venting passage is configured to communicate with a cooking chamber of the cooking device, the part of the exhaust window base located at an outer side of the exhaust window body being provided with second vents, and wherein the second end of the venting passage is configured to communicate with the second vents.

2. The exhaust window assembly of claim 1, wherein the second vents are arranged in an upper surface and/or lower surface of the exhaust window base; and/or, wherein the second vents are arranged at two sides of a width direction of the exhaust window base.

3. The exhaust window assembly of claim 2, wherein in the event that the second vents are arranged in the upper surface and lower surface of the exhaust window base, the second vents are distributed in a corresponding manner in the upper surface and lower surface of the exhaust window base;

wherein in the event that the second vents are arranged at two sides of the width direction of the exhaust window base, the second vents are distributed in an opposite manner at the two sides of the width direction of the exhaust window base.

4. The exhaust window assembly of claim 1, wherein the exhaust window base is arranged to be close to a lower edge of the exhaust window body; and wherein the first vents are located above the exhaust window base, or the first vents are located above the exhaust window base and at two, left and right, sides of the exhaust window base.

5. The exhaust window assembly of claim 4, wherein an outer surface of the exhaust window base is provided with a wind shield located at an inner side of the exhaust window body and configured to guide wind to the first vents; and/or wherein the exhaust window base is of a box-shape structure enclosing the venting passage, the box-shape structure being provided, at an end located at the inner side of the exhaust window body, with an air inlet configured to communicate with the cooking chamber.

6. The exhaust window assembly of claim 1, wherein the part of the exhaust window base located at the outer side of the exhaust window body has a length of 25 mm or more, the exhaust window base being arranged transversely on the exhaust window body.

7. The exhaust window assembly of claim 1, wherein the exhaust window body and the exhaust window base are formed integrally.

8. The exhaust window assembly of claim 1, wherein the part of the exhaust window base located at the outer side of the exhaust window body comprises a flange extending upward vertically and arranged along its edge.

9. A cooking device comprising:

a housing which is provided with a mounting opening and inside which there is a heat dissipation passage; and the exhaust window assembly of claim 1, the exhaust window body being arranged at the mounting opening, the heat dissipation passage being in communication with the first vents.

10. The cooking device of claim 9, wherein the exhaust window body is provided at an outer peripheral face with a position limiting rib, an end face of the position limiting rib oriented towards an outer side and the outer peripheral face of the exhaust window body forming a mounting notch; and wherein an edge of the mounting opening is embedded in the mounting notch at the outer periphery of the exhaust window assembly.

11. The cooking device of claim 9 further comprising:

a liner arranged inside the housing, the cooking chamber being located in the liner, the liner being provided at its top with an air outlet which is in communication with the cooking chamber and the venting passage of the exhaust window assembly, wherein the exhaust window base has a connecting structure at its end located at an inner side of the exhaust window body, the connecting structure being connected to an outer periphery of the air outlet in the liner.

12. The cooking device of claim 11, wherein the connecting structure is located at an inner side of the venting passage;

wherein the connecting structure comprises a plurality of insertion parts and a plurality of threaded posts arranged in a spaced apart manner in a circumferential direction of the venting passage; and wherein a wall face surrounding the air outlet in the liner is provided with a plurality of first insertion holes and a plurality of second insertion holes, the plurality of first insertion holes being distributed in a manner of corresponding to the plurality of insertion parts one by one, the plurality of second insertion holes being distributed in a manner of corresponding to the plurality of threaded posts one by one, each of the insertion parts being inserted into a corresponding first insertion hole, each screw passing through the second insertion hole to be inserted into a corresponding threaded post.

13. The cooking device of claim 11, wherein the housing comprises a housing rear lid at which the mounting opening is arranged;

wherein the liner comprises a liner top wall and liner side walls located at two sides of a width direction of the liner top wall, the housing rear lid connecting the two liner side walls from a rear side and enclosing the cooking chamber together with the liner;

wherein a part of the housing rear lid that is opposite the liner extends vertically; or wherein the part of the housing rear lid that is opposite the liner protrudes outward to form an extended cooking chamber which has an extension length smaller than or equal to a protrusion length, in a horizontal direction, of a protruding rib provided on an end of the exhaust window base located at the outer side of the exhaust window body and away from the exhaust window body.

14. The exhaust window assembly of claim 1, wherein the exhaust window base comprises a protruding rib on an end thereof located at the outer side of the exhaust window body and away from the exhaust window body.

* * * * *